US005871126A

United States Patent [19]

Bennett et al.

[11] Patent Number: 5,871,126

[45] Date of Patent: Feb. 16, 1999

[54] PUMP DISPENSER

[75] Inventors: Robert Bennett, Easton; James Lynn Turbett, Stamford, both of Conn.; Mark John Iaia, Valley Cottage, N.Y.; John Bengston, Ridgefield, Conn.

[73] Assignee: Chesebrough-Pond's USA Co., Division of Conopco, Inc., Greenwich, Conn.

[21] Appl. No.: 773,806

[22] Filed: Dec. 18, 1996

Related U.S. Application Data

[60] Provisional application No. 60/010,291 Jan. 22, 1996.

[51] Int. Cl.[6] ..... B67D 5/42

[52] U.S. Cl. ..... 222/207; 222/380; 222/383.3

[58] Field of Search ..... 222/207, 211, 222/212, 215, 380, 382, 383.1, 383.3

[56] References Cited

U.S. PATENT DOCUMENTS

| | | | |
|---|---|---|---|
| D. 351,991 | 11/1994 | Bertolini et al. . | |
| 2,815,890 | 12/1957 | Cooprider et al. | 222/207 |
| 2,853,210 | 9/1958 | Stewart et al. | 222/207 |
| 3,090,529 | 5/1963 | Lipman | 222/209 |
| 3,102,489 | 9/1963 | Corsette et al. | 222/207 |
| 3,162,333 | 12/1964 | Davidson | 222/207 |
| 3,162,334 | 12/1964 | Miller . | |
| 3,486,663 | 12/1969 | Humphrey . | |
| 3,685,739 | 8/1972 | Vanier | 222/383 X |
| 3,752,366 | 8/1973 | Lawrence, Jr. . | |
| 3,753,518 | 8/1973 | Kutik | 222/383 |
| 3,820,689 | 6/1974 | Cocita | 222/207 |
| 3,874,562 | 4/1975 | Hazard . | |
| 3,907,174 | 9/1975 | Steiman | 222/383 |
| 3,910,458 | 10/1975 | Ewald | 222/383 X |
| 4,322,020 | 3/1982 | Stone . | |
| 4,469,250 | 9/1984 | Evezich . | |
| 4,865,230 | 9/1989 | Tugwood | 222/383 |
| 5,492,252 | 2/1996 | Gueret | 222/207 |

*Primary Examiner*—Kenneth Bomberg
*Attorney, Agent, or Firm*—Milton L. Honig

[57] ABSTRACT

A pump dispenser is described for dispensing a product through a pumping mechanism that draws product from a storage container upwards through a dip tube, across a check valve, into a collecting chamber from which it is dispensed through a one-way monitoring valve and exits a nozzle. Flow is initiated by compression of a domed elastomeric wall covering the collecting chamber. A vent system of conduits including a conical ring valve brings air into the container to equalize pressure upon release of compression against the elastomeric wall. The one-way monitoring valve, downstream from the collecting chamber, may be formed as a duckbill valve of elastomeric rubber having an exit slit at the dispensing end. This slit, normally closed, will open upon pressure from a product flow. Excellent control of dispensing amounts is achieved through the pumping mechanism.

9 Claims, 4 Drawing Sheets

PUMP DISPENSER

This Application claims benefit of provisional application 60/010,291 filed Jan. 22, 1996.

BACKGROUND OF THE INVENTION

1. Field of the Invention

The invention concerns a vented pump dispenser for delivery of liquid and semi-liquid products.

2. The Related Art

A variety of pumping devices are commercially available to deliver liquid and semi-liquid products, e.g. cosmetics. Commonly these devices feature a dip-tube with an activateable head as illustrated in U.S. Des. Pat. No. 351,991 (Bertolini et al.). Most prior art pumps involve the use of one-way ball valves, springs, sliding pistons, sealing elements and related engineering elements.

Various disadvantages are associated with known pump mechanisms. Those mechanisms involving a rectilinear reciprocable piston require a user to depress a plunger along a given direction. Lateral pressure causes binding of the piston. Consequently, this arrangement may at times be awkward to actuate. Certainly it is not ergonomically designed.

Another disadvantage is that only partial control is achieved over the amount of product dispensed. Traditional pumps require a user to complete a full stroke. A unit of product is thereby forced from the container even though the user may desire less than a unit dose.

Still a further disadvantage is that traditional pump heads are aesthetically displeasing. They are awkward and gangly in appearance. Moreover, the elongated gangly head generally rises to a height that sometimes renders it difficult to store within a medicine cabinet or shelf.

Some of these problems have been addressed in the patent literature. For instance, U.S. Pat. No. 3,486,663 (Humphrey) describes a pump or check-valve consisting of an elastomeric member having a recessed portion adapted for sealing engagement with a supporting surface to define therewith a closed chamber. The supporting surface has two ports opening into the chamber; the elastomeric member has one or two partitions dividing the chamber into a respective number of compartments. These compartments are sloping in relation to the bottom surface of the dispenser.

A more ergonomically and aesthetically pleasing design is reported in U.S. Pat. No. 3,752,366 (Lawrence, Jr.) illustrating a dome-shaped section, siphon tube with seal and dispensing orifice.

Other pertinent devices are found in U.S. Pat. No. 3,874,562 (Hazard). The patent discloses a deformable container with a dispensing closure having a cap and a rotary spout adapted to be moved between open and closed positions. The spout serves as a pump to exhaust the contents of the container. Check valves may be mounted on a fitment within the cap to serve as a part of the closure itself.

U.S. Pat. No. 3,162,334 (Miller) reports a pumping member including a domed diaphragm defining a variable volume chamber. Valve means are formed in a collar surrounding the domed diaphragm to control fluid flow which may exit through a spout.

Although many improvements have been reported in the art, there still remains a need for improved functionality and ergonomics. Accordingly, it is an object of the present invention to provide a pump dispenser where product flow can be very precisely controlled to deliver even fractional portions of a full pumping stroke.

Another object of the present invention is to provide a pump dispenser of relatively low profile which can be more readily stored than those of the known art.

Still another object of the present invention is to provide a pump dispenser with an actuating member which can be depressed by hand pressure from practically any angle.

SUMMARY OF THE INVENTION

A pump dispenser is provided including:

(i) a container for storing a pumpable product having a closed and an open end;

(ii) a pump mechanism for drawing the product from the container and dispensing same, the pump mechanism being positioned over the open end of the container and including:

(a) a dip tube with upper and lower ends extending downward into the container for drawing product therefrom;

(b) a collecting chamber for receiving product drawn upward from the dip tube;

(c) a mechanism interposed between the upper end of the dip tube and the collecting chamber for introducing air into the container;

(d) an elastomeric wall at least partially positioned over and communicating with the collecting chamber, the elastomeric wall being resiliently pressable thereby compressing the collecting chamber;

(e) a dispensing member communicating with the collecting chamber and having an exit orifice through which product can flow outward; and (f) a one-way monitoring valve downstream from the collecting chamber controlling the outward flow through the dispensing member.

Advantageously the one-way monitoring valve will be a flip down turret nozzle outwardly pivotable through an arc of at least 60°. Moreover, the one-way monitoring valve preferably is formed of an elastomeric rubber having a slitted end. Flow is regulated by variation of pressure exerted to open the normally closed rubber exit slit.

The mechanism for introducing air into the container is a conical cylindrical ring serving as an air inlet valve. The cylindrical ring is concentric with a vertical axis defining a length of the dip tube.

Product flow from the dip tube into the collecting chamber is regulated by a check valve having a ball movable from a seated to an unseated position above a seat opening. The mechanism for introducing air and the check valve are lodged within a valve fitment.

BRIEF DESCRIPTION OF THE DRAWING

The above objects, features and advantages of the present invention will become more clearly understood in connection with the detailed description of preferred embodiments, when considered with the accompanying drawing in which.

DETAILED DESCRIPTION OF THE INVENTION

Figure 1:
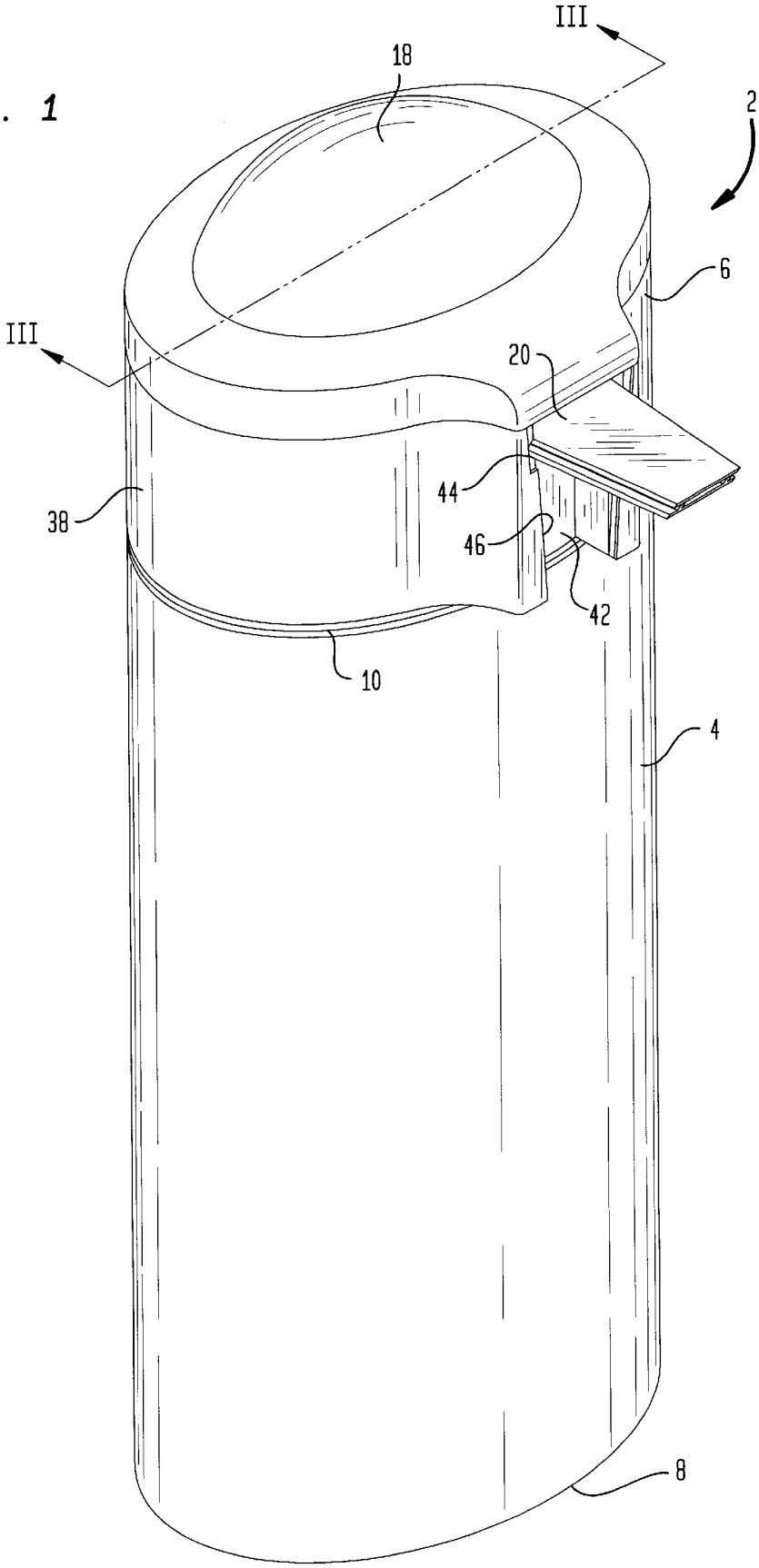
FIG. 1 is a front elevational view of a pump dispenser according to the present invention.

According to the present invention there is provided a pump dispenser 2 consisting of a container 4 mounted with a pump mechanism 6. Container 4 has a closed end 8 and an open end 10. Pump mechanism 6 is positioned over the open end 10 of the container 4.

The pump mechanism 6 includes a dip tube 12, a collecting chamber 14, a mechanism for introducing air 15, a valve fitment 16, a check valve 17, an elastomeric wall 18, a dispensing member 20 and a one-way monitoring valve 22. Dip tube 12 has an upper end 24 and a lower end 26, the lower end 26 extending downward into container 4 to draw product 28 therefrom. Collecting chamber 14 receives product 28 drawn upward from the dip tube 12. Check valve 17 is interposed between the upper end 24 of the dip tube 12 and the collecting chamber 14. The elastomeric wall 18 is a dome-shaped structure at least partially positioned over and communicating with the collecting chamber 14. The elastomeric wall is resiliently pressable downwardly. When activated, the elastomeric wall compresses the collecting chamber. The dispensing member 20 communicates with the collecting chamber to allow product flow therebetween. The one-way monitoring valve 22 is positioned downstream from the collecting chamber 14. This monitoring valve controls the outward product flow through the dispensing member.

Figure 2:
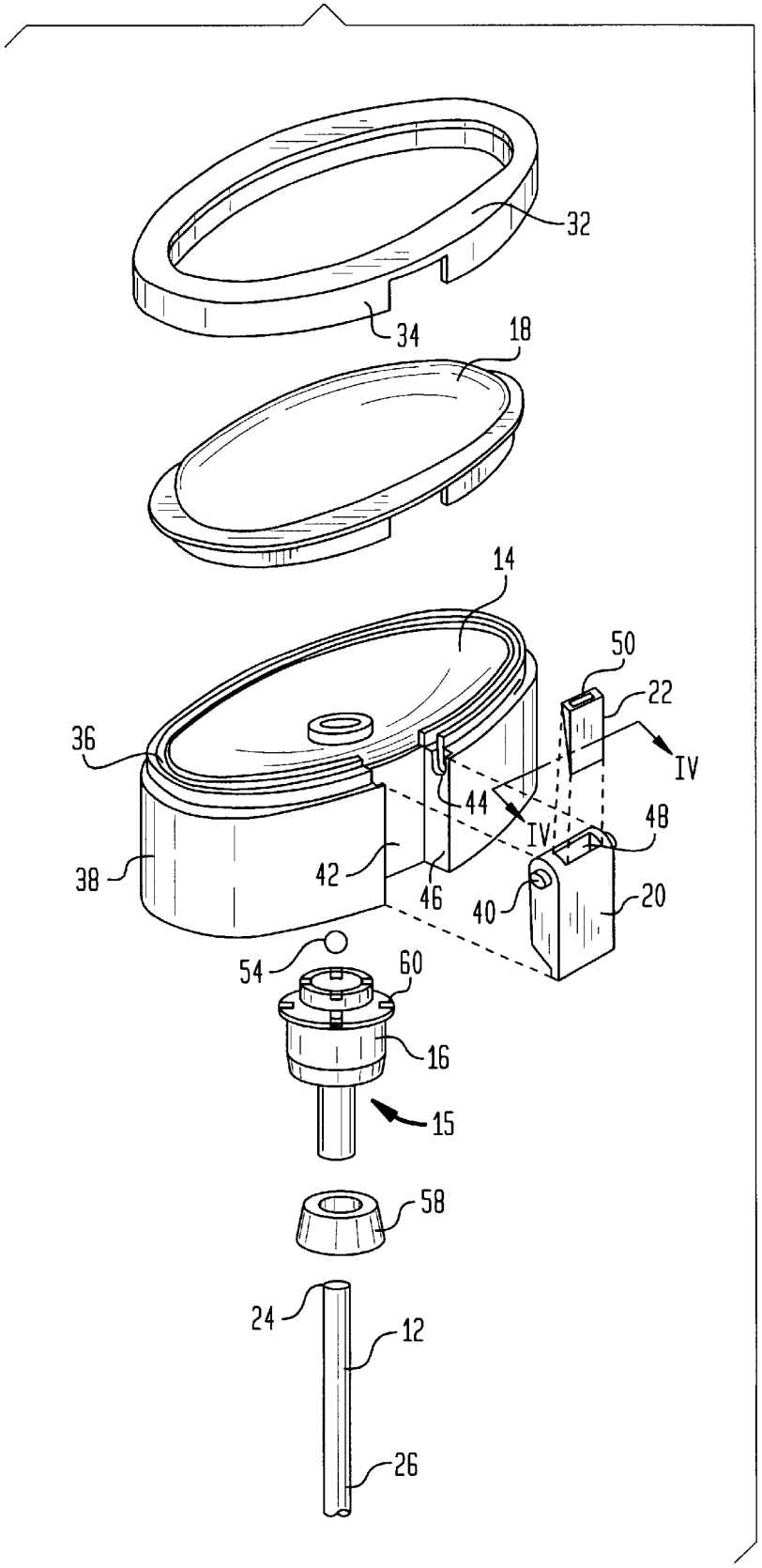
FIG. 2 is an exploded view of the pump dispenser assembly, with the container omitted.

FIG. 2 illustrates the relative relationships of the various components of the pump dispenser. The embodiment shown in FIG. 1–2 has an oval cross section container. Cap locking ring 32 holds the elastomeric wall 18 in place as a roof over collecting chamber 14. Cap locking ring 32 along its periphery has a skirt 34 whose edges engage a grooved track 36 circumscribing the collecting chamber 14. An apron 38 projects downwardly from the collecting chamber surrounding same.

Dispensing member 20 is formed as a turret nozzle pivoting on a pair of pinions 40. The nozzle can assume a closed position by nesting within elongate recess 42 formed in the apron 38. Recess 42 is defined by a pair of parallel sidewalls 46. Pinions 40 are rotatingly set into complementary indentations 44 of sidewalls 46. Dispensing member 20 can pivot through an arc of at least 60°, preferably through an arc of 90°.

Figure 4A:
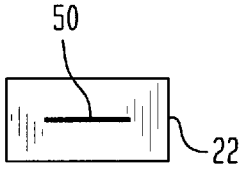
FIG. 4*a* is a cross sectional view of the elastomeric rubber valve insert, shown in FIG. 2, in its closed orifice position.
Figure 4B:
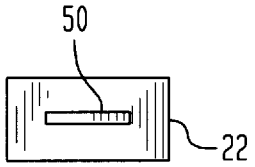
FIG. 4*b* is a cross sectional view of the elastomeric rubber valve insert, shown in FIG. 2, in its open orifice position.

One-way monitoring valve 22 is shown as a wedge shaped elastomeric plug insertable into passageway 48 traversing the dispensing member. Within the elastomeric plug is a central flow orifice 50. Cross sectional views of the plug illustrated in FIG. 4*a* and 4*b* show the central flow orifice 50 in respective closed and open positions. Normally the plug, also known as a duckbill valve, is in a closed relationship. Only upon pressure of product flowing through the dispensing member 20 does the central flow orifice open.

Figure 5:
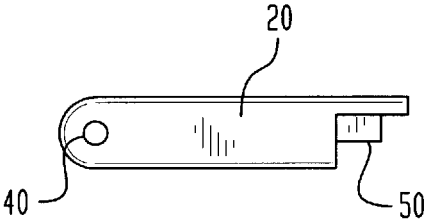
FIG. 5 is a side view of a second embodiment of the turret nozzle, shown in FIG. 2, the nozzle being totally formed of an elastomeric rubber.
Figure 6:
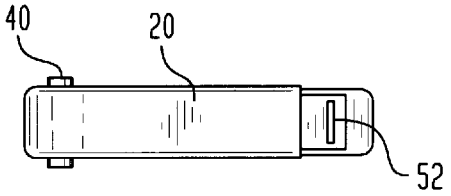
FIG. 6 is a bottom plan view of the turret nozzle as shown in FIG. 5.

An alternative embodiment of dispensing member 20 is illustrated in FIGS. 5 and 6. This embodiment avoids insertion of any elastomeric plug. Instead, the overall dispensing member is itself formed from an elastomeric rubber. Valve control is achieved with a slit 52 or flap valve transverse to the longitudinal axis of the dispensing member. Normally slit 52 is closed; only upon pressure of flow through a central passageway of the dispensing member 20 will the slit open.

Figure 3:
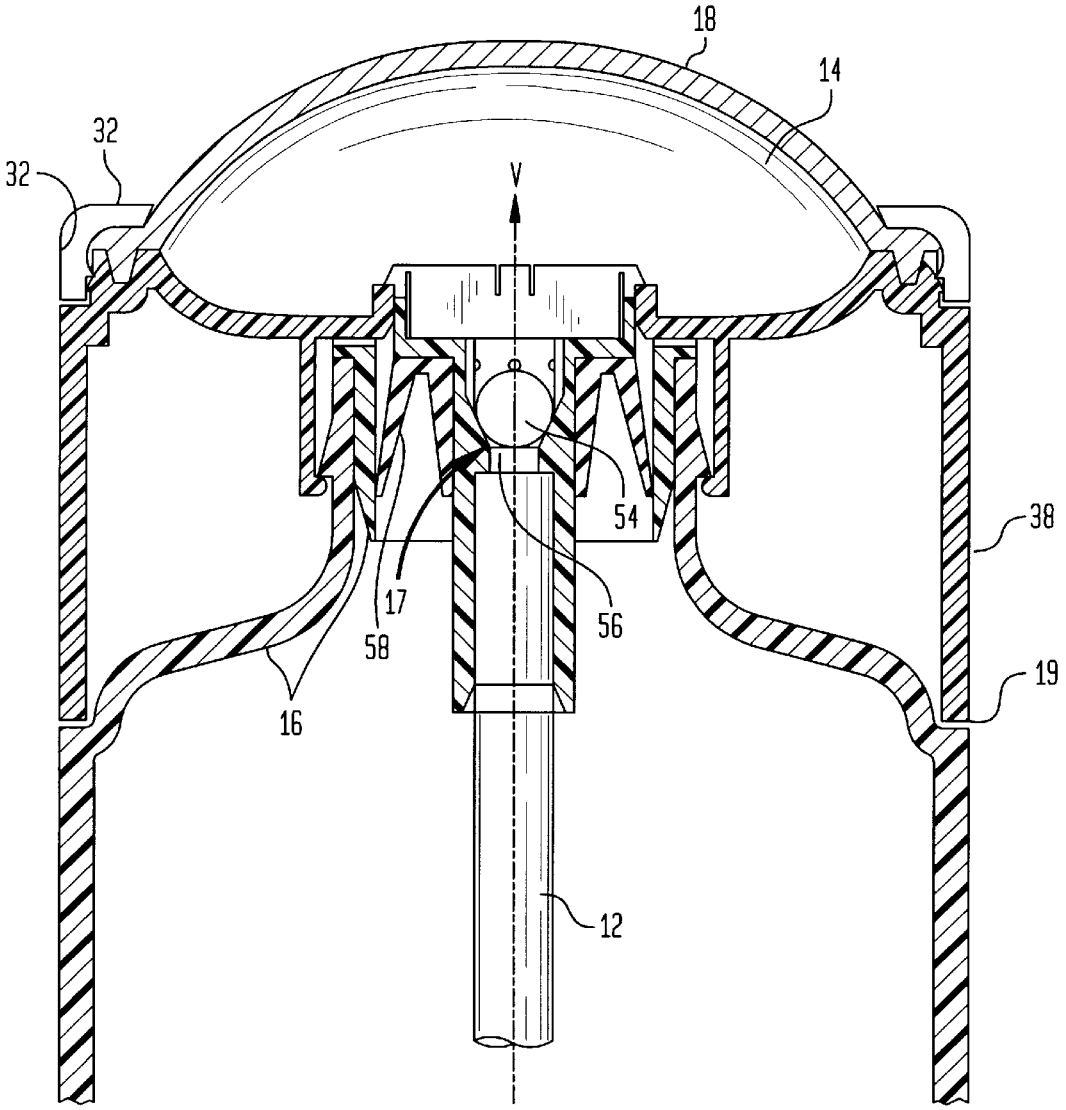
FIG. 3 is a cross sectional view along III—III of FIG. 1.

FIG. 3 illustrates in cross-section the mechanism 15 for introducing air and the check valve 17. The check valve includes a steel ball 54 shown seated over seat opening 56 adjacent the upper end 24 of the dip tube. The mechanism for introducing air is a conical cylindrical ring 58 serving as an air inlet valve. A vertical axis V traverses a length of dip tube 12. The cylindrical ring is concentric with the vertical axis V.

The dispensing mechanism of the pump operates in the following manner. First, the turret nozzle 20 is pivoted into its outward open position. The user then through finger pressure depresses the elastomeric wall 18. Product 28 held within collecting chamber 14 is forced outward and through the turret nozzle. Recharging of the system begins when the elastomeric wall 18 rebounds into its resting position (shown in FIG. 3). Removal of pressure against the elastomeric wall causes ball 54 to unseat which allows product to flow upward through the dip tube into collecting chamber 14. Displaced product from the container induces a slight vacuum in container 4. This vacuum is relieved by air entering channel 19 under apron 38 and passes through vent channel 60. Thereafter conical ring 58 is deflected permitting sufficient air into the container to achieve atmospheric pressure. By this procedure, the system is again primed for further product delivery.

The foregoing description and drawing represent typical embodiments of the present invention but are not intended as limitations on the scope thereof, it being understood that the invention can be practiced through obvious modifications and rearrangements without departing from the essential spirit thereof.

What is claimed is:

1. A pump dispenser comprising:

(i) a container of oval cross section having a closed and an open end storing a pumpable product;

(ii) a pump means for drawing the product from the container and dispensing same, the pump means being positioned over the open end of the container and comprising:

(a) a dip tube with upper and lower ends extending downward into the container for drawing product therefrom;

(b) a collecting chamber for receiving product drawn upward from the dip tube;

(c) a means interposed between the upper end of the dip tube and the collecting chamber for introducing air into the container;

(d) an elastomeric wall at least partially positioned over and communicating with the collecting chamber, the elastomeric wall being resiliently pressable thereby compressing the collecting chamber;

(e) a dispensing member communicating with the collecting chamber having an exit orifice through which product can flow outward, the dispensing member being shaped as a turret nozzle, the nozzle arranged at an upstream end to pivot through a vertical arc of at least 60° from an outwardly pointing to a downwardly pointing direction; and (f) a one-way monitoring valve downstream from the collecting chamber controlling the outward flow through the dispensing member.

2. The dispenser according to claim 1 further comprising a check valve to regulate product flow, the check valve being positioned between the upper end of the dip tube and the collecting chamber.

3. The dispenser according to claim 2 wherein the means for introducing air and the check valve are lodged within a valve fitment.

4. The dispenser according to claim 1 wherein the elastomeric wall is domed.

5. The dispenser according to claim 4 wherein the elastomeric wall is of oval shape.

6. The dispenser according to claim 1 wherein a cap locking ring holds the elastomeric wall in place over the collecting chamber.

7. The dispenser according to claim 1 wherein the one-way monitoring valve is formed of an elastomeric rubber, flow through the valve being regulated by pressure exerted to open a normally closed exit slit.

8. A pump dispenser comprising:

(i) a container for storing a pumpable product having a closed and an open end;

(ii) a pump means for drawing the product from the container and dispensing same, the pump means positioned over the open end of the container and comprising:

(a) a dip tube with upper and lower ends extending downward into the container for drawing product therefrom;

(b) a collecting chamber for receiving product drawn upward from the dip tube;

(c) a means interposed between the upper end of the dip tube and the collecting chamber for introducing air into the container;

(d) an elastomeric wall at least partially positioned over and resiliently pressable downwardly thereby compressing the collecting chamber;

(e) a dispensing member having an exit orifice communicating with the collecting chamber through which product can flow outward, the dispensing member being shaped as a turret nozzle, the nozzle arranged at an upstream end to pivot through a vertical arc of at least 60° from an outwardly pointing to a downwardly pointing direction; and (f) a one-way monitoring valve downstream from the collecting chamber controlling the outward flow through the dispensing member.

9. A pump dispenser comprising:

(i) a product container for storing a pumpable product having a closed and an open end;

(ii) a pump means for drawing the product from the container and dispensing same, the pump means being positioned over the open end of the container and comprising:

(a) a dip tube with upper and lower ends extending downward into the container for drawing product therefrom;

(b) a collecting chamber for receiving product drawn upward from the dip tube;

(c) a means interposed between the upper end of the dip tube and the collecting chamber for introducing air into the container;

(d) an elastomeric wall at least partially positioned over and communicating with the collecting chamber, the elastomeric wall being resiliently pressable thereby compressing the collecting chamber;

(e) a dispensing member communicating with the collecting chamber having an exit orifice through which product can flow outward; and (f) a one-way monitoring valve downstream from the collecting chamber controlling the outward flow through the dispensing member, the dispensing member being shaped as a turret nozzle, the nozzle arranged at an upstream end to pivot through a vertical arc of at least 60° from an outwardly pointing to a downwardly pointing direction, the monitoring valve comprising an elastomeric rubber, flow therethrough being regulated by a pressure exerted to open a normally closed rubberized exit slit.

* * * * *